US008209982B2

(12) United States Patent
Sumser et al.

(10) Patent No.: US 8,209,982 B2
(45) Date of Patent: Jul. 3, 2012

(54) INTERNAL COMBUSTION ENGINE HAVING TWO EXHAUST GAS TURBOCHARGERS CONNECTED IN SERIES

(75) Inventors: Siegfried Sumser, Stuttgart (DE); Michael Stiller, Schwaikheim (DE); Peter Fiedersbacher, Stuttgart (DE)

(73) Assignee: Daimler AG, Stuttgart (DE)

( * ) Notice: Subject to any disclaimer, the term of this patent is extended or adjusted under 35 U.S.C. 154(b) by 462 days.

(21) Appl. No.: 12/079,934

(22) Filed: Mar. 28, 2008

(65) Prior Publication Data

US 2008/0223039 A1 Sep. 18, 2008

Related U.S. Application Data

(63) Continuation-in-part of application No. PCT/EP2006/008478, filed on Aug. 30, 2006.

(30) Foreign Application Priority Data

Sep. 29, 2005 (DE) ..... 10 2005 046 507

(51) Int. Cl.

| | |
|---|---|
| ***F02B 33/44*** | (2006.01) |
| ***F02B 33/00*** | (2006.01) |
| ***F02D 23/00*** | (2006.01) |
| ***F04D 15/00*** | (2006.01) |
| ***F04D 27/00*** | (2006.01) |

(52) U.S. Cl. ..... 60/612; 60/602; 123/562; 415/157; 415/158

(58) Field of Classification Search ..... 60/600, 60/602, 606, 614, 615, 612; 123/562; 415/157–158
See application file for complete search history.

(56) References Cited

U.S. PATENT DOCUMENTS

| | | | | |
|---|---|---|---|---|
| 4,367,626 | A * | 1/1983 | Schwartzman | 60/606 |
| 4,557,665 | A * | 12/1985 | Szczupak | 415/158 |
| 4,776,168 | A * | 10/1988 | Woollenweber | 60/602 |
| 4,886,416 | A * | 12/1989 | Wunderlich | 415/158 |
| 4,894,990 | A * | 1/1990 | Tsubouchi | 60/602 |
| 5,758,500 | A * | 6/1998 | Sumser et al. | 60/602 |
| 5,855,117 | A * | 1/1999 | Sumser et al. | 60/602 |
| 6,216,459 | B1 * | 4/2001 | Daudel et al. | 60/602 |
| 6,220,031 | B1 * | 4/2001 | Daudel et al. | 60/602 |
| 6,374,611 | B2 * | 4/2002 | Doring et al. | 415/157 |
| 6,478,536 | B2 * | 11/2002 | Doring et al. | 415/158 |
| 6,536,214 | B2 * | 3/2003 | Finger et al. | 60/602 |
| 6,715,288 | B1 * | 4/2004 | Engels et al. | 60/602 |
| 6,931,849 | B2 * | 8/2005 | Parker | 60/602 |
| 7,021,057 | B2 * | 4/2006 | Sumser et al. | 60/602 |
| 7,048,503 | B2 * | 5/2006 | Doring et al. | 415/158 |
| 7,162,872 | B2 * | 1/2007 | Schmid et al. | 60/602 |

(Continued)

FOREIGN PATENT DOCUMENTS

DE 3101131 A1 * 8/1982

(Continued)

*Primary Examiner* — Thai Ba Trieu
(74) *Attorney, Agent, or Firm* — Klaus J. Bach

(57) ABSTRACT

In an internal combustion engine having two exhaust gas turbochargers which are connected in series and a bypass line which bypasses the exhaust gas turbine close to the engine and extends to a collecting space of the turbine remote from the engine, and a blow-off valve is integrated into the turbine housing of the remote exhaust gas turbine for controlling a communication path between the collecting space and the turbine wheel, and includes a control sleeve supported axially movably between a closed position in which the communication path is blocked and a fully open position in which a flow path by-passing the turbine wheel of the turbine remote from the engine is provided.

6 Claims, 2 Drawing Sheets

U.S. PATENT DOCUMENTS

| | | | | |
|---|---|---|---|---|
| 7,207,176 | B2 * | 4/2007 | Mulloy et al. | 60/602 |
| 7,562,529 | B2 * | 7/2009 | Kuspert et al. | 60/605.2 |
| 7,644,585 | B2 * | 1/2010 | Haugen | 60/612 |
| 7,658,068 | B2 * | 2/2010 | Mulloy et al. | 60/602 |
| 7,828,517 | B2 * | 11/2010 | Serres | 415/157 |
| 8,037,683 | B2 * | 10/2011 | Wirbeleit et al. | 60/602 |
| 2002/0043066 | A1 * | 4/2002 | Finger et al. | 60/602 |
| 2003/0230085 | A1 * | 12/2003 | Sumser et al. | 60/602 |
| 2004/0128997 | A1 * | 7/2004 | Parker | 60/602 |
| 2005/0252211 | A1 * | 11/2005 | Schmid et al. | 60/602 |
| 2005/0262841 | A1 * | 12/2005 | Parker | 60/602 |
| 2006/0207253 | A1 * | 9/2006 | Sumser et al. | 60/602 |
| 2009/0060719 | A1 * | 3/2009 | Haugen | 415/145 |
| 2009/0064679 | A1 * | 3/2009 | Parker | 60/602 |
| 2009/0120087 | A1 * | 5/2009 | Sumser et al. | 60/600 |
| 2010/0037605 | A1 * | 2/2010 | Garrett et al. | 60/602 |
| 2012/0031092 | A1 * | 2/2012 | Sumser et al. | 60/602 |

FOREIGN PATENT DOCUMENTS

| | | | |
|---|---|---|---|
| DE | 101 44 663 | | 4/2003 |
| DE | 102 22 919 | | 12/2003 |
| DE | 102006001571 | A1 * | 8/2007 |
| EP | 1 396 619 | | 3/2004 |
| FR | 2 831 611 | | 5/2003 |
| JP | 01 190920 | | 8/1989 |

* cited by examiner

INTERNAL COMBUSTION ENGINE HAVING TWO EXHAUST GAS TURBOCHARGERS CONNECTED IN SERIES

This is a Continuation-In-Part Application of pending international patent application PCT/EP2006/008478 filed Aug. 30, 2006 and claiming the priority of German patent application 10 2005 046 507.2 filed Sep. 29, 2005.

BACKGROUND OF THE INVENTION

The invention relates to an internal combustion engine having two exhaust gas turbochargers which are connected in series with the turbines arranged in the exhaust tract and the compressors arranged in the intake tract.

An internal combustion engine of this type is known from DE 101 44 663 Al. The internal combustion engine is fitted with two exhaust gas turbochargers which are connected in series and of which the charger close to the engine is a high-pressure stage and the charger remote from the engine is a low-pressure stage. The compressors of the two exhaust gas turbochargers are connected in series in the intake tract, and the exhaust gas turbines of the two chargers are likewise arranged in series in the exhaust tract. In order to ensure that the high-pressure turbine close to the engine is not overloaded and thereby damaged in the upper speed and load range of the engine, a bypass is provided which bypasses the high-pressure turbine and which opens out into the exhaust gas line between the high-pressure and low-pressure turbines. Situated in the bypass is an adjustable blow-off valve which is adjusted as a function of state and operating variables of the internal combustion engine, in particular of the exhaust gas back pressure upstream of the high-pressure turbine close to the engine. A further bypass is provided for bypassing the turbine remote from the engine; an adjustable blow-off valve is also arranged in cold the bypass.

By means of the blow-off valves in the two bypass lines, it is possible for a blow-off past one or past both exhaust gas turbines to be carried out depending on the situation.

Based on the prior art, it is the object of the present invention to utilize the energy potential contained in the exhaust gas so as to increase the overall efficiency in the best possible way, that is, when the exhaust gas turbine close to the engine is active and also when the exhaust gas turbine is bypassed.

SUMMARY OF THE INVENTION

In an internal combustion engine having two exhaust gas turbochargers which are connected in series and a bypass line which bypasses the exhaust gas turbine close to the engine and extends to a collecting space of the turbine remote from the engine, and a blow-off valve is integrated into the turbine housing of the remote exhaust gas turbine for controlling a communication path between the collecting space and the turbine wheel, and includes a control sleeve supported axially movably between a closed position in which the communication path is blocked and a fully open position in which a flow path by-passing the turbine wheel of the turbine remote from the engine is provided.

The collecting space is a constituent part of a blow-off valve which is integrated into the turbine housing of the exhaust gas turbine remote from the engine and which also comprises an adjustable valve element which is arranged in the opening section of the collecting space to the turbine wheel. The collecting space is formed separately and is separated by a wall from the exhaust gas inlet channel of the exhaust gas turbine, to which exhaust gas is supplied via the exhaust line which has passed the exhaust gas turbine close to the engine.

With the exhaust gas channel and collecting space being formed separately, additional adjustment possibilities are generated in relation to the prior art, which at the same time permit better utilization of the energy in the exhaust gas. The exhaust gas which is conducted into the collecting space, and which is guided past the exhaust gas turbine close to the engine, impinges, when the blow-off valve is open, that is to say, when the valve element is retracted and in the open position, directly on the turbine wheel of the exhaust gas turbine remote from the engine, and drives the turbine wheel. The valve element can also be adjusted to a position in which the pressurized exhaust gas from the collecting space can, flow via a direct flow path directly to the wheel outlet side of the turbine wheel of the exhaust gas turbine remote from the engine, as a result of which a blow-off of the by-pass exhaust gas supplied to the turbine remote from the engine is also obtained. In this way, both, the turbine close to the engine and also of the turbine remote from the engine, can be bypassed by the by-pass exhaust gas.

A further advantage results from the fact that, when the turbine close to the engine is bypassed, an increased exhaust gas back pressure is obtained in the collecting space in the turbine housing of the turbine remote from the engine because the volume of the collecting space is smaller than that of the exhaust gas channel in the same turbine, which increased exhaust gas back pressure permits high flow speeds of the exhaust gas at which the exhaust gas impinges on the turbine wheel blades. In this way, a higher rotational impetus can be applied to the turbine wheel. The impetus can also be intensified by guide blades, in particular stationary guide blades, which are arranged in the flow passage area between the collecting space and turbine wheel, as the guide blades have flow-enhancing contours and bring about an increase in the flow speed of the exhaust gas.

A valve element expediently in the form of an axially movable control sleeve is mounted in the housing of the turbine which is remote from the engine. The control sleeve can be adjusted between a closed position, in which the flow cross section is blocked or at least reduced to a minimum and an open position in which the flow cross section assumes a maximum. According to one advantageous embodiment, it is provided that, in a largely retracted position of the control sleeve which corresponds to the maximum open position, an open direct flow path between the collecting space and the turbine outlet is provided, bypassing the turbine wheel blades. In this position of the control sleeve, the exhaust gas of the internal combustion engine is conducted both past the turbine wheel of the turbine close to the engine and also past the turbine wheel of the turbine remote from the engine.

Expediently, receiving openings are formed in the front end of the axially movable control sleeve, in which receiving openings the guide blades in the flow cross section between the collecting space and turbine wheel are accommodated when the valve is in the closed position, the guide vanes being preferably fixed with respect to the housing. When the valve is in the closed position, the guide vanes are advantageously received entirely in the receiving openings of the control sleeve, and at the same time, the front end of the control sleeve abuts the wall which delimits the flow passage. In order to open the blow-off valve, the control sleeve can be retracted so far that the free ends of the guide vanes are exposed and the guide vanes are positioned entirely outside the receiving opening of the control sleeve.

The guide vanes are expediently fixedly mounted on a housing-side partition which separates the collecting space from the exhaust gas inlet channel and extends inwardly preferably up to the outer edge of the turbine wheel blades in order to prevent undesired incorrect flows between the collecting space and the exhaust gas inlet channel. The partition advantageously extends radially with respect to the turbine wheel axis.

A compact design is obtained by an integration of the blow-off valve into the housing of the turbine remote from the engine. Here, it is particularly advantageous that only a single actuating drive is necessary for the adjustment of the valve element, that is the control sleeve and therefore for adjusting the blow-off valve.

The invention and its advantages will become more readily apparent from the following description thereof on the basis of the accompanying drawings.

DESCRIPTION OF EXEMPLARY EMBODIMENTS

In the figures, identical components are provided with the same reference symbols.

Figure 1:
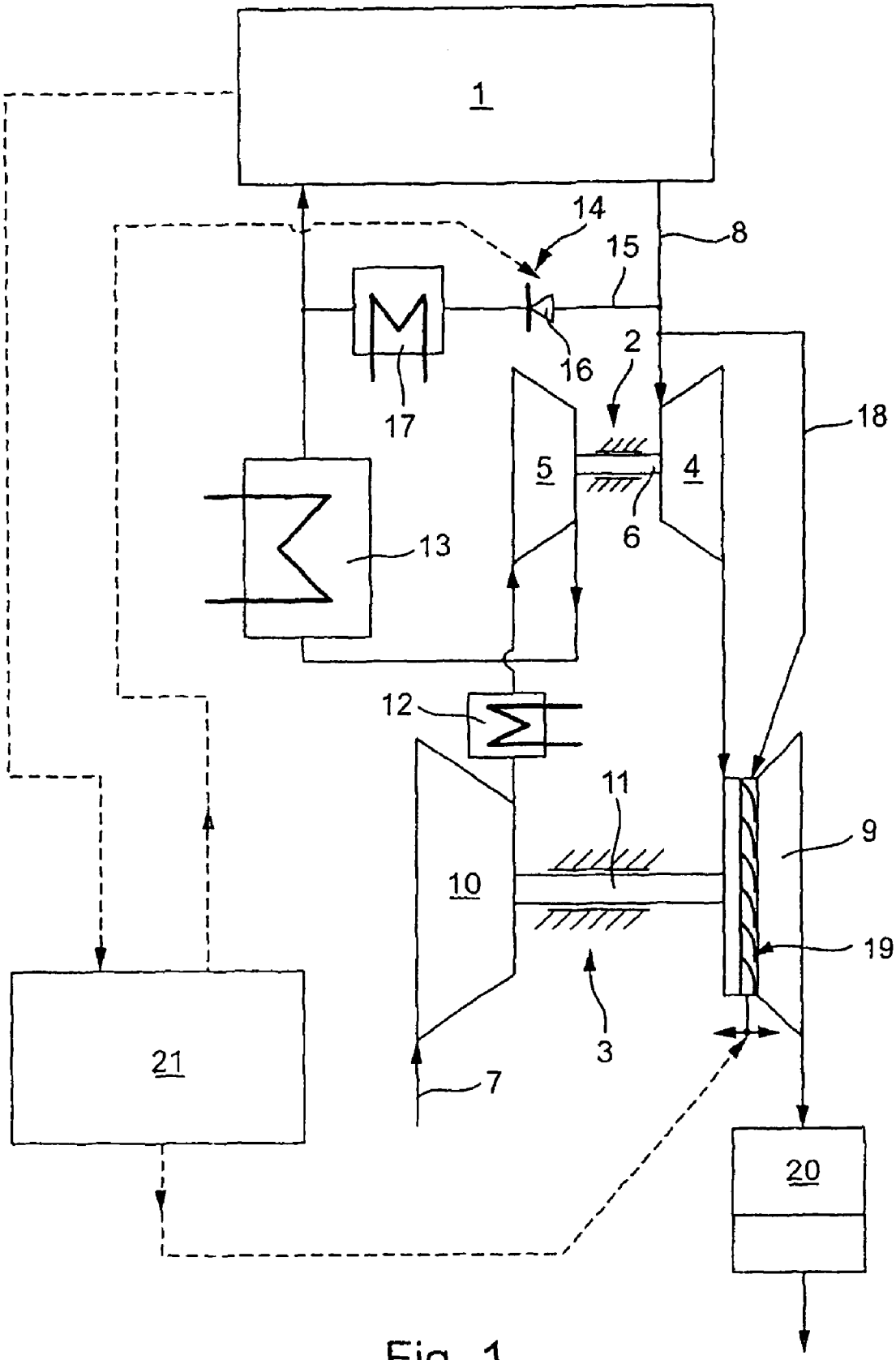
FIG. 1 shows a schematic illustration of an internal combustion engine having two exhaust gas turbochargers connected in series, with the exhaust gas turbine close to the engine being bypassed by a bypass line which extends directly to the exhaust gas turbine remote from the engine.

The internal combustion engine 1 illustrated in FIG. 1—a spark-ignition engine or a diesel internal combustion engine—is provided with two-stage turbocharging with a first exhaust gas turbocharger 2 close to the engine and a second exhaust gas turbocharger 3 remote from the engine, with the exhaust gas turbocharger 2 close to the engine being relatively small and forming the high-pressure stage, and the exhaust gas turbocharger 3 remote from the engine being relatively large and forming the low-pressure stage. The exhaust gas turbocharger 2 close to the engine comprises an exhaust gas turbine 4 in the exhaust strand 8 and a compressor 5 in the intake tract 7 of the internal combustion engine, with the turbine wheel and the compressor wheel being rotationally fixedly connected to one another by means of a shaft 6. In a corresponding way, the exhaust gas turbocharger 3 remote from the engine comprises an exhaust gas turbine 9 in the exhaust strand 8 and a compressor 10 in the intake tract 7, and the turbine wheel and compressor wheel are rotationally fixedly coupled by means of a shaft 11. As viewed in the flow direction, the compressor 10 of the exhaust gas turbocharger 3 remote from the engine is mounted upstream of the compressor 5 of the exhaust gas turbocharger 2 close to the engine, whereas the exhaust gas turbine 9 of the exhaust gas turbocharger 3 remote from the engine is connected downstream of the exhaust gas turbine 4 of the exhaust gas turbocharger 2 close to the engine.

The combustion air which is to be supplied to the internal combustion engine 1 via the intake tract 7 flows firstly through the compressor 10 of the exhaust gas turbocharger 3 remote from the engine, undergoes pre-compression therein, is cooled in a first charge-air cooler 12 after leaving the compressor 10 and then flows through the compressor 5 close to the engine, which is part of the high-pressure stage. After the second compression in the compressor 5, the combustion air which is under increased pressure is cooled in a second charge-air cooler 13 and is subsequently supplied under charge pressure to the cylinders of the internal combustion engine 1.

At the exhaust gas side, the exhaust gas flows firstly through the exhaust gas turbine 4 close to the engine of the high-pressure stage, in which the turbine wheel of the turbine 4 is driven. The exhaust gas which expanded in the turbine 4 to a lower pressure is, after leaving the exhaust gas turbine 4, supplied to the second, downstream exhaust gas turbine 9 of the low-pressure stage, and there, drives the turbine wheel with the remaining potential energy. After essentially complete expansion, the exhaust gas leaves the exhaust gas turbine 9 remote from the engine and, before being discharged, undergoes purification in an exhaust gas purification device 20 which comprises a catalytic converter and if appropriate a filter device.

The internal combustion engine 1 is also fitted with an exhaust gas recirculation device 14 which comprises a recirculation line 15 between the exhaust strand 8 upstream of the exhaust gas turbine 4 close to the engine and the intake tract 7 downstream of the second charge-air cooler 13, and an adjustable check valve 16 and an exhaust gas cooler 17 in the recirculation line 15. In order to reduce the $NO_x$ emissions, it is possible in certain operating states of the internal combustion engine for the check valve 16 to be opened and for a part of the exhaust gas mass flow to be recirculated from the exhaust strand into the intake tract.

In addition, a bypass 18 which bypasses the exhaust gas turbine 4 close to the engine is provided, which bypass 18 branches off from the exhaust strand 8 upstream of the turbine 4 and extends directly to the exhaust gas turbine 9 remote from the engine downstream of the turbine 4. In order to regulate the exhaust gas mass flow which is to be conducted via the bypass 18, a blow-off valve 19 is provided which is integrated into the housing of the exhaust gas turbine 9 remote from the engine and which is described in detail in the following FIGS. 2 and 3.

All the adjustable components of the internal combustion engine, in particular the check valve 16 in the exhaust gas recirculation device 14 and the blow-off valve 19 which is integrated into the exhaust gas turbine 9, are controlled as a function of state and operating variables by means of actuating signals of a control unit 21.

The blow-off via the bypass 18 permits a pressure dissipation of the exhaust gas back pressure upstream of the high-pressure turbine 4, as a result of which an overload of the turbine components can be prevented in particular at high loads and speeds of the internal combustion engine. The exhaust gas which is guided past the turbine 4 close to the engine is conducted via the bypass 18 directly into the turbine 9 remote from the engine, so that the energy contained in the exhaust gas can be utilized for driving the turbine wheel of the low-pressure turbine 9 remote from the engine. In this way, the overall efficiency of the internal combustion engine is improved. By means of a corresponding adjustment of the blow-off valve 19 in the turbine 9, it is however possible for the turbine wheel of the turbine to also be bypassed, so that it is possible to carry out both a bypass of the turbine wheel of the exhaust gas turbine 4 close to the engine and also a bypass of the turbine wheel of the exhaust gas turbine 9 remote from the engine.

Figure 2:
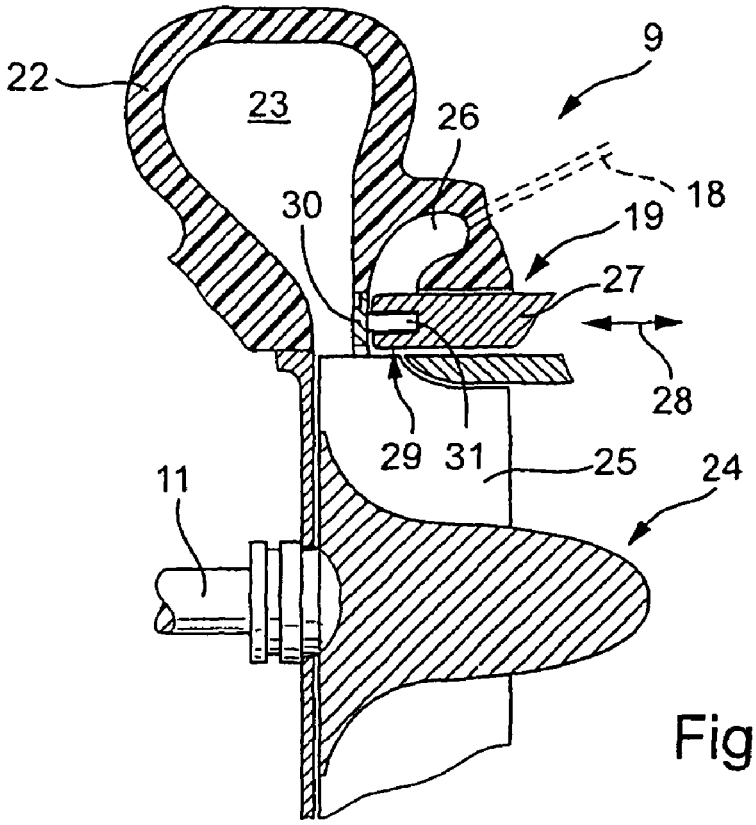
FIG. 2 is a sectional view of the exhaust gas turbine remote from the engine having a larger exhaust gas channel, via which supplied exhaust gas is conducted to the turbine wheel, and having a small collecting space which is formed separately from the exhaust gas channel and which has a flow passage to the turbine wheel with a movably mounted control sleeve, the collecting space being supplied with exhaust gas from the bypass.

FIG. 2 illustrates a section through the exhaust gas turbine 9 remote from the engine. Situated in the turbine housing 22 is an exhaust gas channel 23 which is upstream of the turbine wheel 24 as viewed in the flow direction and into which the exhaust gas from the exhaust gas turbine is introduced via the exhaust strand. From the spiral-shaped exhaust gas channel 23, the pressurized exhaust gas flows via a passage with narrowed flow cross section radially to the turbine wheel blades 25, and imparts a driving impetus to the latter. In the further course, the exhaust gas flows out axially via the outlet of the turbine. The rotational movement of the turbine wheel 24 is transmitted via the shaft 11 to the compressor wheel.

Situated in the turbine housing 22 in addition to the exhaust gas channel 23, but formed separately from the latter, is a collecting space 26 for exhaust gas, the volume of which is considerably smaller than the volume of the exhaust gas channel 23. The bypass 18 which bypasses the exhaust gas turbine close to the engine opens out into the collecting space 26. On account of the relatively small volume of the collecting space 26, and with a narrowest variable flow cross section 29 mounted or situated downstream, it is possible to generate a relatively high exhaust gas back pressure in the collecting space 26.

The collecting space 26 is in communication via flow passage 29 with the turbine wheel 24 via an area radially adjoining the outer circumference of the turbine wheel blades 25. The flow passage 29 is situated directly adjacent to the opening area of the exhaust gas channel 23 to the turbine wheel 24, but is separated from the latter in a flow-tight manner by means of a partition 30 which extends radially with respect to the turbine longitudinal axis.

A control sleeve 27 is also mounted in the turbine housing 22, which control sleeve 27 is axially movable, as per the arrow direction 28, between the closed position shown in FIG. 2, in which the flow cross section 29 is blocked, and a retracted, open position by an actuating drive (not illustrated), with the opening area 29 being opened in the open position of the control sleeve 27, so that the pressurized exhaust gas in the collecting space 26 impinges on the turbine wheel blades 25 via the opening area and acts on the turbine wheel blades 25 with an impetus. In the open position of the control sleeve 27, which has the function of a valve element, the turbine wheel 24 is driven by the exhaust gas supplied via the bypass 18.

The opening area 29 expediently extends annularly around the turbine wheel blades 25. Guide vanes 31 are fixedly arranged on the radially extending partition 30 between the exhaust gas flow passage 23 and the collecting space 26, which guide vanes 31 have flow-enhancing contours and past which guide vanes 31 the exhaust gas passing through the opening area 29 must flow out of the collecting space 26. Here, an additional swirl or an increase in the exhaust gas speed is applied to the exhaust gas, thereby providing for improved and more efficient energy transfer to the turbine wheel 24. The guide vanes 31 are received in openings in the control sleeve 27 when the control sleeve is closed. In this way, the control sleeve 27 can be closed until it abuts the partition 30, as a result of which the opening area 29 is completely closed.

The collecting space 26 and the control sleeve 27 which functions as a valve element together form the blow-off valve 19. The guide vanes 31 are also part of the blow-off valve. If appropriate, it is however also possible to dispense with the guide vanes if the collecting space 26 is of spiral-shaped design over the nozzle periphery 29.

Figure 3:
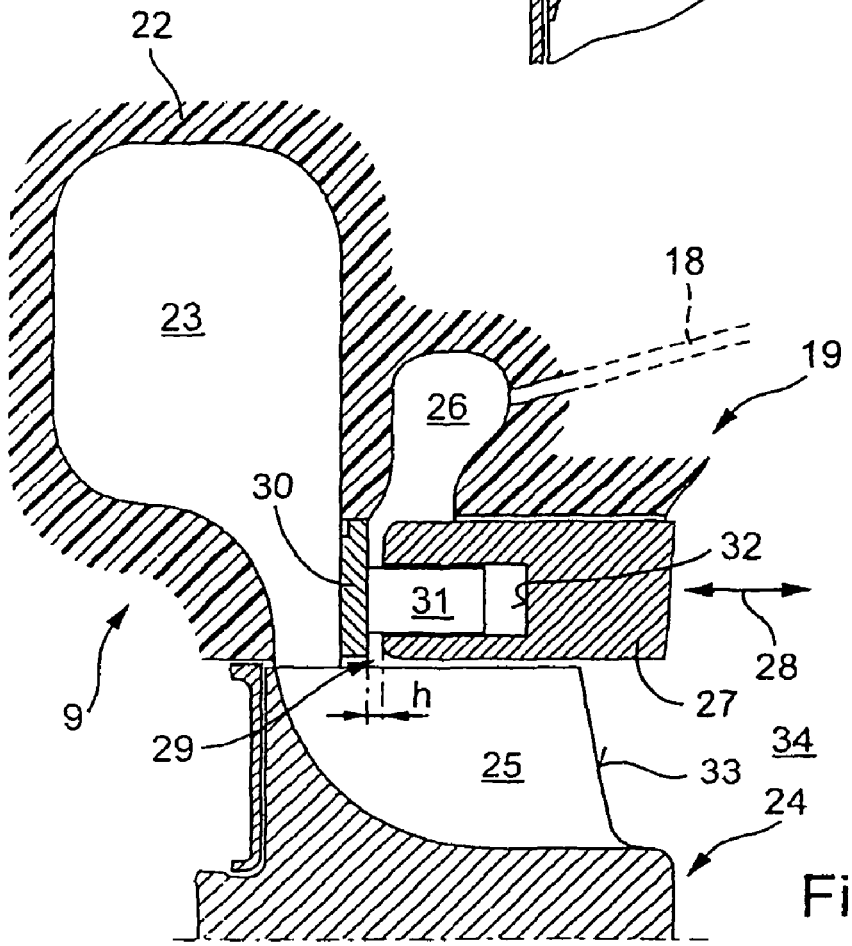
FIG. 3 is a sectional view showing a modified embodiment of an exhaust gas turbine remote from the engine.

FIG. 3 illustrates an embodiment variant of the exhaust gas turbine 9 remote from the engine in section. The basic design corresponds to that of the exemplary embodiment as per FIG. 2, but with the difference that the control sleeve 27 directly adjoins the outer edge of the turbine wheel blades 25. A wall component, which is fixed to the housing, between the turbine wheel blades and the control sleeve 27 as illustrated in FIG. 2 is omitted in the exemplary embodiment as per figure 3. The control sleeve 27 can, in the open position, be moved axially further away from the partition 30 to such an extent that the guide vanes 31 which are fastened to the partition and which extend in the axial direction are situated entirely outside the receiving openings 32 in the end face of the control sleeve 27. In the position axially furthest remote from the partition 30, the end face of the control sleeve 27 which faces toward the partition 30 is still situated upstream of the axial end 33 of the turbine wheel, as a result of which a direct flow path between the collecting space 26 and the turbine outlet 34 is opened for the exhaust gas from the collecting space 26. The retracted position of the control sleeve 27 represents the blow-off position in which the exhaust gas is conducted directly to the turbine outlet 34 and flows out of the turbine while substantially bypassing the turbine wheel blades.

The control sleeve 27 can assume any desired intermediate position between its most remote open position and the closed position, as denoted symbolically in FIG. 3 by the plotted variable spacing h between the end side of the control sleeve 27 and the partition 30. Important positions to be specified are the closed position, in which the opening cross section 29 is blocked by the control sleeve, a first open position in which the opening area 29 is opened but a direct flow connection between the collecting space 26 and the turbine outlet 34 is blocked by the control sleeve, and a second open or blow-off position in which the control sleeve 27 is retracted so far that its axial end is situated downstream of the turbine wheel outflow end 33, as a result of which a direct flow path is opened between the collecting space and the turbine outlet.

The invention claimed is:

1. An internal combustion engine (1) including an intake tract (7) and one exhaust tract (8), a first turbocharger (2) arranged near the engine (1) and a second turbocharger (3) arranged remote from the engine (1), each including an exhaust gas turbine (4, 9) arranged in series in the exhaust tract (8) and a compressor (10, 5) arranged in series in the intake tract (7), a by-pass line (18) extending from the exhaust tract (8) upstream of the turbine (4) of the first turbocharger (2) to the turbine (9) of the second turbocharger (3), said second turbocharger turbine (9) including a turbine wheel (24), a first exhaust gas channel (23) for directing exhaust gas to the turbine wheel (24) from the first turbocharger turbine (4) and a second exhaust gas channel (26) connected to the bypass line (18) and having an opening area (29) for conducting exhaust gas to the second exhaust gas turbocharger turbine wheel (24), and a blow-off valve (19) integrated into the second exhaust gas turbocharger turbine (9) and including an adjustable control sleeve (27) arranged in the turbine housing so as to be movable into, and out of, the opening area (29) for controlling the exhaust gas flow through the bypass line (18) to the turbine wheel (24), the adjustable control sleeve (27) being movable between a fully inserted position In which the opening area (29) is closed so as to block any exhaust gas flow through the by-pass line (18) to the second turbocharger turbine (9), an intermediate position, in which the opening area (29) is at least partially open for controlling the exhaust gas flow volume through the by-pass line (18) to the turbine (9) of the second turbocharger (3) around the turbine (4) of the first turbocharger (2) and a fully retracted position in which the control sleeve (27) is axially spaced from the opening area (29) so as to provide for a flow path through the by-pass line (18) to an outlet (34) of the turbine (9) of the second turbocharger (3) by-passing the turbine (4) of the first turbocharger (2) and the turbine wheel (24) of the turbine (9) of the second turbocharger (3).

2. The internal combustion engine as claimed in claim 1, wherein guide vanes are disposed in the opening area (29), and the control sleeve (27) delimits the effective length of the opening area (29) of the second exhaust gas channel (26) and of the effective length of guide vanes (31) which are arranged in the opening area (29) between the second exhaust gas channel (26) and turbine wheel (24).

3. The internal combustion engine as claimed in claim 2, wherein the guide vanes (31) are supported so as to be fixed with respect to the housing and the control sleeve (27) includes an axial receiving opening (32) for accommodating the guide vanes (31).

4. The internal combustion engine as claimed in claim 3, wherein the second exhaust gas channel (26) is separated from the first exhaust gas channel (23) by a radial partition which extends up to the turbine wheel blades (25).

5. The internal combustion engine as claimed in claim 4, wherein the guide vanes (31) are connected to the partition (30).

6. The internal combustion engine as claimed in claim 1, wherein, in the closed or partially closed position of the control sleeve (27) , the inner, surface of the control sleeve (27) directly adjoins the turbine wheel blades (25).

* * * * *